US011353194B2

(12) United States Patent
Zhan

(10) Patent No.: US 11,353,194 B2
(45) Date of Patent: Jun. 7, 2022

(54) MULTIFUNCTIONAL LIGHT-CONTROL ACCESSORY FRAME

(71) Applicant: Xiamen Fulaishi Film Tools Co., Ltd., Xiamen (CN)

(72) Inventor: Qiang Zhan, Xiamen (CN)

(73) Assignee: Xiamen Fulaishi Film Tools Co., Ltd., Xiamen (CN)

( * ) Notice: Subject to any disclaimer, the term of this patent is extended or adjusted under 35 U.S.C. 154(b) by 964 days.

(21) Appl. No.: 15/699,638

(22) Filed: Sep. 8, 2017

(65) Prior Publication Data

US 2018/0066829 A1 Mar. 8, 2018

(30) Foreign Application Priority Data

Sep. 8, 2016 (CN) ..... 201610809296.0

(51) Int. Cl.
*F21V 14/08* (2006.01)
*F21V 13/02* (2006.01)
(Continued)

(52) U.S. Cl.
CPC ..... *F21V 14/08* (2013.01); *F21V 13/02* (2013.01); *F21V 11/183* (2013.01); *F21V 17/02* (2013.01); *F21Y 2105/10* (2016.08)

(58) Field of Classification Search
CPC ..... F21V 14/04; F21V 14/08; F21V 13/02; F21V 11/183; F21V 17/02; F21V 7/18
See application file for complete search history.

(56) References Cited

U.S. PATENT DOCUMENTS 5,134,548 A * 7/1992 Turner ..... B67D 7/222 349/67
8,038,315 B1 * 10/2011 Santoro ..... F21V 3/0625 362/224

(Continued)

FOREIGN PATENT DOCUMENTS

GB 2526801 * 9/2015 ..... F21L 4/00

*Primary Examiner* — Zheng Song
(74) *Attorney, Agent, or Firm* — Alan M. Sack; SACK IP Law p.c.

(57) ABSTRACT

The present invention provides a multifunctional light-control accessory frame, which includes at least three accessory borders and at least three angle joints, the three angle joints connecting the three accessory borders to form a frame. An inverted buckling member for being joined with a lamp body is laterally and perpendicularly disposed on a side wall of the angle joint. A sheet mounting groove for mounting a light-control sheet and a lattice mounting groove for mounting a beam-forming lattice are disposed on the inner side of the accessory border. A light shielding plate mounting area and a filter paper clamping plate mounting area are disposed on the outer side of the accessory border. A light shielding plate quick-mounting structure is mounted on the light shielding plate mounting area, at least two positioning plates are disposed on the light shielding plate mounting area, and the light shielding plate quick-mounting structure is locked onto the positioning plates. By means of the light-control accessory frame of the present invention, light-control assemblies can be replaced according to different use requirements, and can be replaced or combined conveniently to satisfy different use requirements.

9 Claims, 4 Drawing Sheets

(51) Int. Cl.

| | |
|---|---|
| *F21V 17/02* | (2006.01) |
| *F21Y 105/10* | (2016.01) |
| *F21V 11/18* | (2006.01) |

(56) References Cited

U.S. PATENT DOCUMENTS

| | | | | |
|---|---|---|---|---|
| 9,772,655 | B1 * | 9/2017 | Brooks | F21K 9/60 |
| 9,885,460 | B2 * | 2/2018 | Tang | F21V 7/0066 |
| 2005/0129460 | A1 * | 6/2005 | Medcalf | E06B 3/5454 403/403 |
| 2007/0056701 | A1 * | 3/2007 | Brooker | E06B 9/52 160/381 |
| 2011/0286209 | A1 * | 11/2011 | Vazquez | F21V 7/18 362/217.15 |

* cited by examiner

MULTIFUNCTIONAL LIGHT-CONTROL ACCESSORY FRAME

TECHNICAL FIELD

The present invention relates to an auxiliary component of a lighting fixture, and more particularly to a multifunctional light-control accessory frame.

BACKGROUND ART

A lighting fixture generally includes a lamp body and a light-control accessory. An existing light-control accessory is usually formed by merely splicing four simple borders. It is inconvenient to arrange light-control members on such light-control accessory. Hence, it is inconvenient to mount light-control members such as light-control sheets, beam-forming lattices, and light shielding plates on a light-control accessory formed by splicing borders, and it is also inconvenient to operate when the light-control members need to be replaced.

SUMMARY OF THE INVENTION

To solve the above technical problem, the present invention provides a multifunctional light-control accessory frame, through which light-control assemblies can be replaced according to different use requirements, and can be replaced or combined conveniently to satisfy different use requirements; and light shielding plates can be rapidly replaced through light shielding plate quick-mounting structures.

The present invention is implemented as follows. A multifunctional light-control accessory frame includes at least three accessory borders and at least three angle joints, the three angle joints connecting the three accessory borders to form a frame. An inverted buckling member for being joined with a lamp body is laterally and perpendicularly disposed on a side wall of the angle joint. A sheet mounting groove for mounting a light-control sheet and a lattice mounting groove for mounting a beam-forming lattice are disposed on the inner side of the accessory border. A light shielding plate mounting area and a filter paper clamping plate mounting area are disposed on the outer side of the accessory border. A light shielding plate quick-mounting structure is mounted on the light shielding plate mounting area.

Further, the light shielding plate quick-mounting structure includes two rotary shaft fixing screws, two accessory quick-mounting assemblies, and a rotary shaft connecting rod. The rotary shaft connecting rod is provided in advance with a plane for mounting a light shielding plate. The two accessory quick-mounting assemblies are disposed on the accessory border, the two rotary shaft fixing screws are respectively located on upper and lower ends of the rotary shaft connecting rod, and the rotary shaft fixing screws pass through the accessory quick-mounting assemblies to be locked onto the rotary connecting rod.

Further, the accessory quick-mounting assembly includes a rotary shaft, an accessory fixing plate, and two damping gaskets. The two damping gaskets are disposed on upper and lower ends of the rotary shaft, the accessory fixing plate is fixed on a side wall of the rotary shaft, an end part of the accessory fixing plate is provided with an accessory quick-mounting slot, and the rotary shaft fixing screw passes through the two damping gaskets and the rotary shaft to be locked onto the rotary connecting rod. The fixing screw passes through the accessory quick-mounting slot and the positioning plate to lock the accessory fixing plate onto a side surface of the accessory border.

Further, the rotary shaft connecting rod is provided with two threaded holes, and the fixing screws pass through the threaded holes to lock the light shielding plate onto the plane of the rotary shaft connecting rod.

Further, the light shielding plate is provided with holes for mounting adjustable blades, and the adjustable blades are mounted on the light shielding plate through adjustable blade rotary shafts. The adjustable blade rotary shaft includes two discs and a connecting column, and the two discs are disposed on two ends of the connecting column.

Further, a protruding pattern is provided on the surface of the angle joint.

Further, the protruding pattern is formed of multiple bumps.

Further, the frame is a closed polygonal frame.

Further, the filter paper clamping plate mounting area is provided with a filter paper clamping plate.

Further, the light shielding plate mounting area is provided with at least one positioning plate, and the light shielding plate quick-mounting structure is locked onto the positioning plate.

Further, the sheet mounting groove is a groove with a slope, and the light shielding plate mounting area is a T-shaped groove which is narrow outside and wide inside.

The present invention has the following advantages. The light-control accessory frame of the present invention consists of three accessory borders and at least three angle joints, a sheet mounting groove for mounting a light-control sheet and a lattice mounting groove for mounting a beam-forming lattice are disposed on the inner side of the accessory border; and a light shielding plate mounting area and a filter paper clamping plate mounting area are disposed on the outer side of the accessory border. Therefore, light-control members can be well mounted in the light-control accessory frame; the light-control members can be replaced according to different use requirements, and can be replaced or combined conveniently to satisfy different use requirements. Besides, the light shielding plate quick-mounting structure includes two rotary shaft fixing screws, two accessory quick-mounting assemblies, and a rotary shaft connecting rod, the two accessory quick-mounting assemblies being fixed on a side surface of the accessory border, the two rotary shaft fixing screws being respectively located on upper and lower ends of the rotary shaft connecting rod, and the rotary shaft fixing screws passing through the accessory quick-mounting assemblies to be locked onto the rotary shaft connecting rod. Therefore, the light shielding plate can be placed on the plane of the rotary shaft connecting rod, and the light shielding plate quick-mounting structure can be rapidly mounted and dismounted through the accessory quick-mounting assemblies, thereby bringing convenience to users.

BRIEF DESCRIPTION OF THE DRAWINGS

The present invention is further described below by embodiments with reference to the accompanying drawings.

DETAILED DESCRIPTION OF THE PREFERRED EMBODIMENTS

Figure 1:
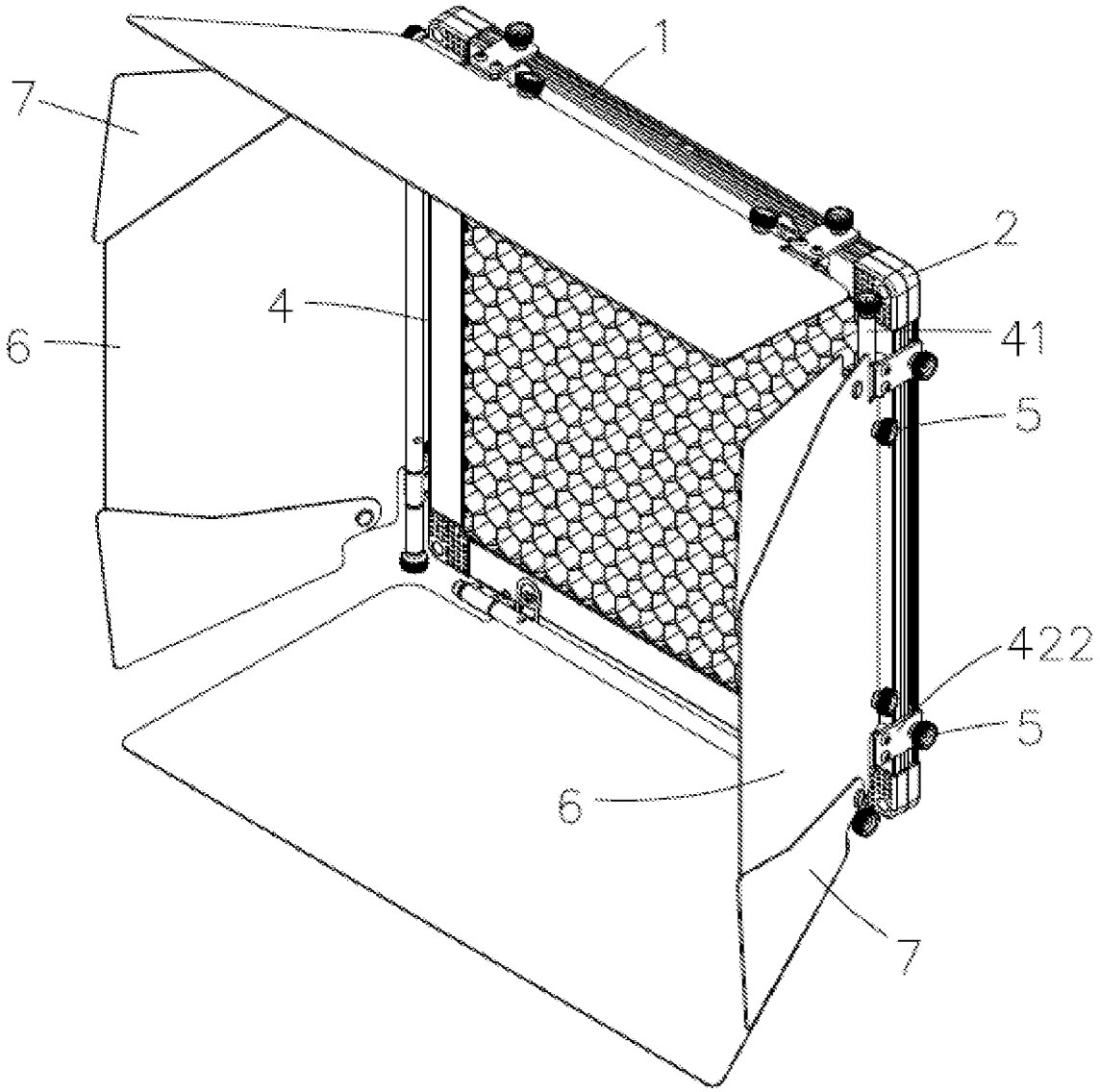
FIG. 1 is a schematic structural diagram of the present invention.
Figure 2:
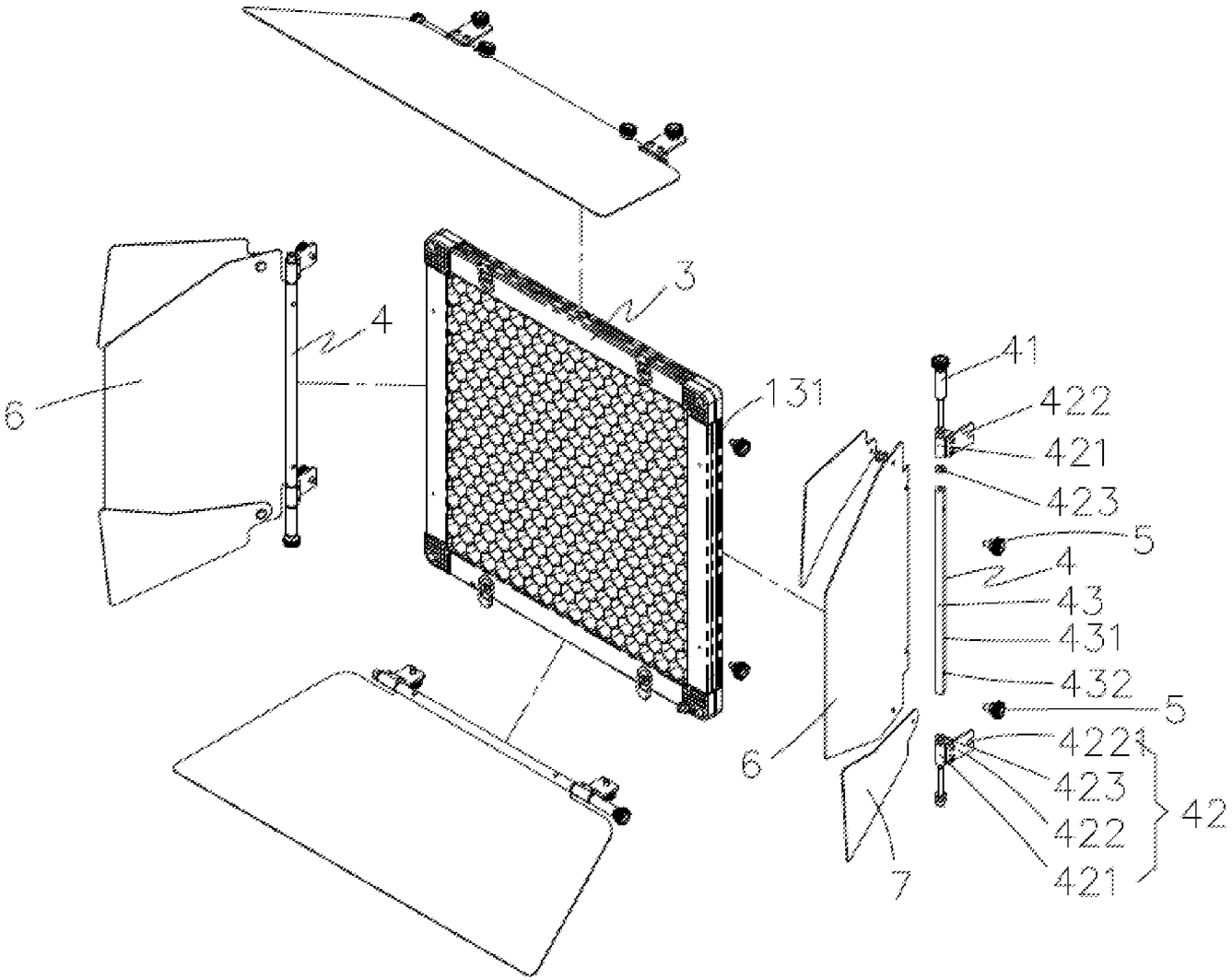
FIG. 2 is an exploded diagram of the present invention.
Figure 3:
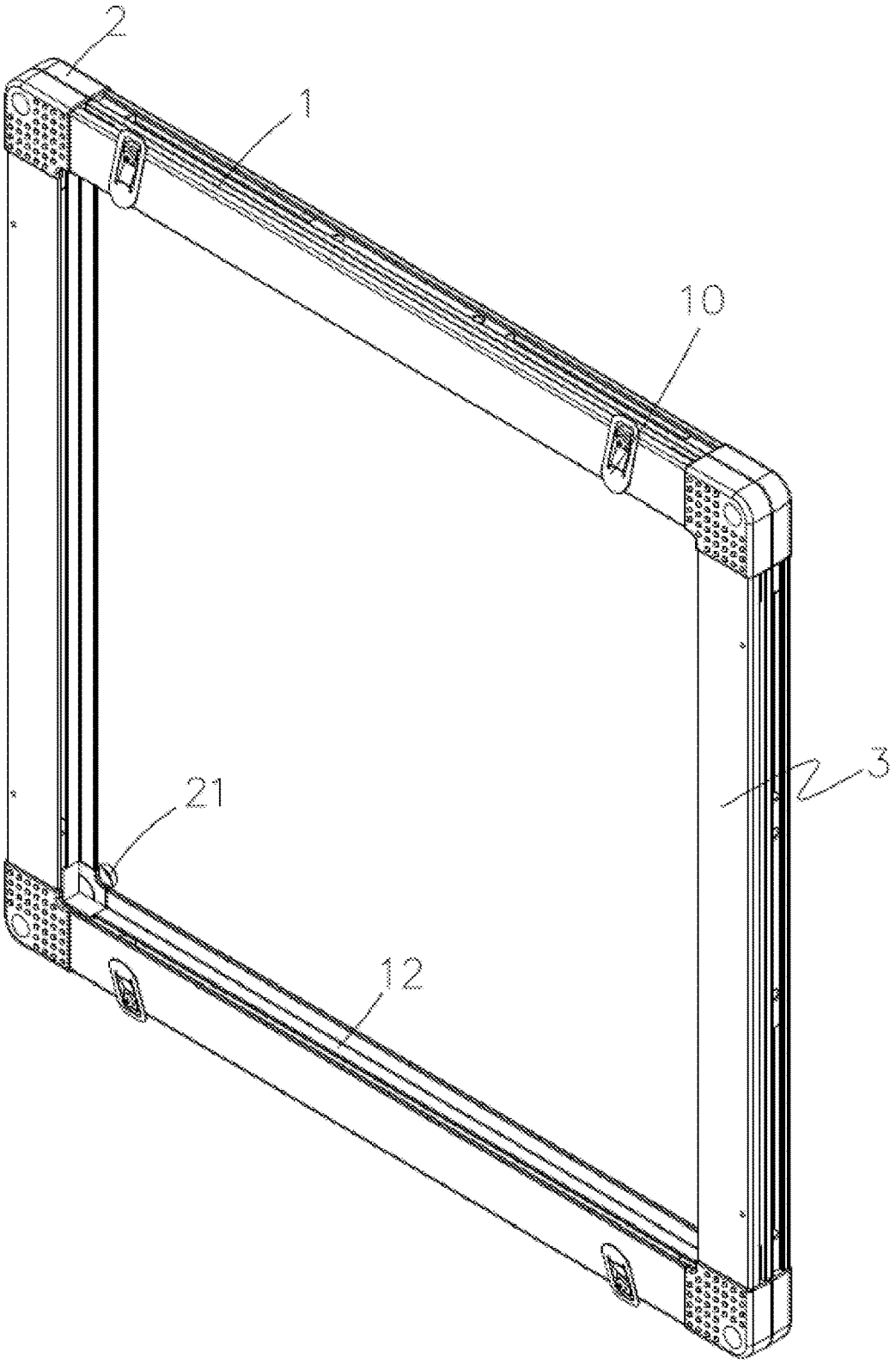
FIG. 3 is a schematic structural diagram of a frame of the present invention.
Figure 4:
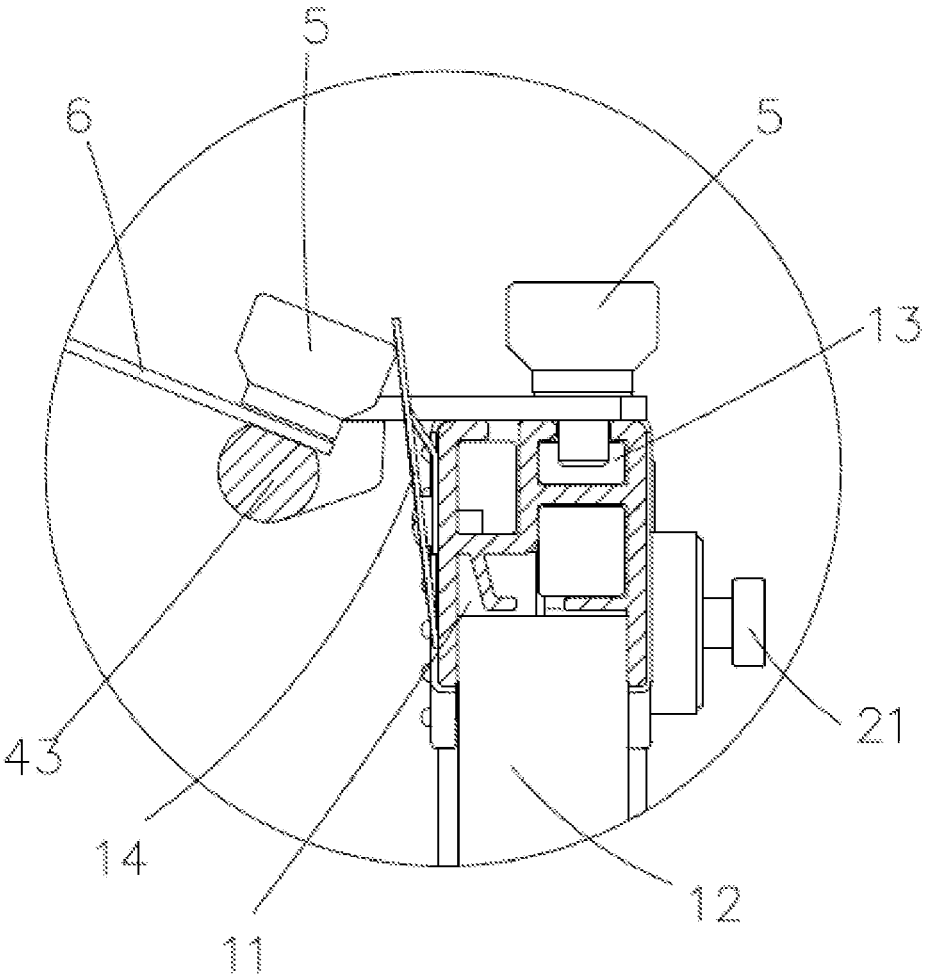
FIG. 4 is a schematic partial diagram of an accessory border of the present invention.

Referring to FIG. 1 to FIG. 4, a multifunctional light-control accessory frame includes at least three accessory borders 1 and at least three angle joints 2, the three angle joints 2 connecting the three accessory borders 1 to form a frame 3. Preferably, as shown in FIG. 1, four accessory borders 1 and four angle joints 2 are provided in the present utility model, and other quantities of the accessory borders 1 and the angle joints 2 may be set according to requirements in the actual application. An inverted buckling member 21 for being joined with a lamp body is laterally and perpendicularly disposed on a side wall of the angle joint 2. A sheet mounting groove 11 for mounting a light-control sheet and a lattice mounting groove 12 for mounting a beam-forming lattice are disposed on the inner side of the accessory border 1. A light shielding plate mounting area 13 and a filter paper clamping plate mounting area 14 are disposed on the outer side of the accessory border 1. Therefore, a light-control sheet can be mounted in the sheet mounting groove 11, a beam-forming lattice can be mounted in the lattice mounting groove 12, and a light shielding plate quick-mounting structure 4 is mounted on the light shielding plate mounting area 13, so it is rather convenient to mount and dismount a light-control member. The light shielding plate mounting area 13 is provided with at least one positioning plate 131, and the light shielding plate quick-mounting structure 4 is locked onto the positioning plate 131. The sheet mounting groove 11 is a groove with a slope, the light shielding plate mounting area 13 is a T-shaped groove which is narrow outside and wide inside, and tight nuts may be placed in the grooves for mounting an accessory. The angle joint 2 is a right-angle joint or a joint of other shapes.

In the present invention, the light shielding plate quick-mounting structure 4 includes two rotary shaft fixing screws 41, two accessory quick-mounting assemblies 42, and a rotary shaft connecting rod 43. The rotary shaft connecting rod 43 is provided in advance with a plane 431 for mounting a light shielding plate. The two accessory quick-mounting assemblies 42 are disposed on the accessory border 410, the two rotary shaft fixing screws 41 are respectively located on upper and lower ends of the rotary shaft connecting rod 43, and the rotary shaft fixing screws 41 pass through the accessory quick-mounting assemblies 42 to be locked onto the rotary shaft connecting rod 43. Therefore, the light shielding plate 6 can be placed on the plane 431, and the light shielding plate quick-mounting structure 4 can be rapidly mounted and dismounted through the accessory quick-mounting assemblies 42.

In the present invention, the accessory quick-mounting assembly 42 includes a rotary shaft 421, an accessory fixing plate 422, and two damping gaskets 423. The two damping gaskets 423 are disposed on upper and lower ends of the rotary shaft 421, the accessory fixing plate 422 is fixed on a side wall of the rotary shaft 421, an end part of the accessory fixing plate 422 is provided with an accessory quick-mounting slot 4221, and the rotary shaft fixing screw 41 passes through the two damping gaskets 423 and the rotary shaft 421 to be locked onto the rotary shaft connecting rod 43. The fixing screw 5 passes through the accessory quick-mounting slot 4221 and the positioning plate 131 to lock the accessory fixing plate 422 onto a side surface of the accessory border 1. The damping gaskets 423 can reduce the friction between the parts. Therefore, as the fixing screw 5 passes through the accessory quick-mounting slot 4221 and the positioning plate 131 to lock the accessory fixing plate 422 onto a side surface of the accessory border 1, the light shielding plate quick-mounting structure can be rapidly mounted and dismounted. In use, the fixing screw 5 disposed in advance on the accessory border 1 may be slightly loosened, and then tightened after the accessory quick-mounting slot 4221 is aligned with the positioning plate 131 to complete mounting.

The rotary shaft connecting rod 43 is provided with two threaded holes 432, and the fixing screws 5 pass through the threaded holes 432 to lock the light shielding plate 6 onto the plane 431 of the rotary shaft connecting rod 43. The light shielding plate 6 mounted through the fixing screws 5 can be rapidly mounted and dismounted. In use, the fixing screws 5 disposed in advance in the threaded holes 432 on the rotary shaft connecting rod 43 may be slightly loosened, and then tightened after the light shielding plate is placed on the plane 431 to complete mounting.

The light shielding plate 6 is provided with holes 61 for mounting adjustable blades, and the adjustable blades 7 are mounted on the light shielding plate 6 through adjustable blade rotary shafts 8. The adjustable blades 7 are used to increase or decrease the angle of the light shielding plate according to requirements. The adjustable blade rotary shaft 8 includes two discs 81 and a connecting column 82, the two discs 81 being disposed on two ends of the connecting column 82. Therefore, the adjustable blades 7 can be conveniently mounted on the light shielding plate 6.

In the present invention, a protruding pattern 9 is provided on the surface of the angle joint 2. Therefore, the light-control accessory frame can be well mounted on the lamp body through the protruding pattern 9, and the protruding pattern 9 can increase the friction.

The protruding pattern 9 is formed of multiple bumps. In the actual application, the protruding pattern 9 may be squares formed of horizontal and vertical lines; or may be wavy lines.

The frame 3 is a closed polygonal frame. The filter paper clamping plate mounting area 14 is provided with a filter paper clamping plate 10.

In view of the above, the light-control accessory frame of the present invention consists of at least three accessory borders and at least three angle joints, a sheet mounting groove for mounting a light-control sheet and a lattice mounting groove for mounting a beam-forming lattice are disposed on the inner side of the accessory border; and a light shielding plate mounting area and a filter paper clamping plate mounting area are disposed on the outer side of the accessory border. Therefore, light-control members can be well mounted in the light-control accessory frame; the light-control members can be replaced according to different use requirements, and can be replaced or combined conveniently to satisfy different use requirements. Besides, the light shielding plate quick-mounting structure includes two rotary shaft fixing screws, two accessory quick-mounting assemblies, and a rotary shaft connecting rod, the two accessory quick-mounting assemblies being fixed on a side surface of the accessory border, the two rotary shaft fixing screws being respectively located on upper and lower ends of the rotary shaft connecting rod, and the rotary shaft fixing screws passing through the accessory quick-mounting assemblies to be locked onto the rotary shaft connecting rod. Therefore, the light shielding plate can be placed on the plane of the rotary shaft connecting rod, and the light shielding plate quick-mounting structure can be rapidly mounted and dismounted through the accessory quick-mounting assemblies, thereby bringing convenience to users.

Although the specific implementation of the present invention is described above, persons skilled in the art should understand that the specific embodiments described herein are merely illustrative, and are not intended to limit the scope of the present invention. Any equivalent modifications and changes made by persons skilled in the art according to the spirit of the present invention shall fall within the protection scope of the appended claims of the present invention.

The invention claimed is:

1. A multifunctional light-control accessory frame, comprising at least three accessory borders and at least three angle joints, the three angle joints connecting the three accessory borders to form a frame, wherein an inverted buckling member for being joined with a lamp body is laterally and perpendicularly disposed on a side wall of the angle joint;

a sheet mounting groove for mounting a light-control sheet and a lattice mounting groove for mounting a beam-forming lattice are disposed on the inner side of the accessory border;

a light shielding plate mounting area and a filter paper clamping plate mounting area are disposed on the outer side of the accessory border; and a light shielding plate quick-mounting structure is mounted on the light shielding plate mounting area, wherein the light shielding plate quick-mounting structure comprises two rotary shaft fixing screws, two accessory quick-mounting assemblies, and a rotary shaft connecting rod, the rotary shaft connecting rod being provided in advance with a plane for mounting a light shielding plate; and wherein the two accessory quick-mounting assemblies being disposed on the accessory border, the two rotary shaft fixing screws being respectively located on upper and lower ends of the rotary shaft connecting rod, and the rotary shaft fixing screws passing through the accessory quick-mounting assemblies to be locked onto the rotary connecting rod.

2. The multifunctional light-control accessory frame according to claim 1, wherein a protruding pattern is provided on the surface of the angle joint.

3. The multifunctional light-control accessory frame according to claim 2, wherein the protruding pattern is formed of multiple bumps.

4. The multifunctional light-control accessory frame according to claim 1, wherein the accessory quick-mounting assembly comprises a rotary shaft, an accessory fixing plate, and two damping gaskets, the two damping gaskets being disposed on upper and lower ends of the rotary shaft, the accessory fixing plate being fixed on a side wall of the rotary shaft, an end part of the accessory fixing plate being provided with an accessory quick-mounting slot, the rotary shaft fixing screw passing through the two damping gaskets and the rotary shaft to be locked onto the rotary connecting rod; and the fixing screw passing through the accessory quick-mounting slot and the positioning plate to lock the accessory fixing plate onto a side surface of the accessory border.

5. The multifunctional light-control accessory frame according to claim 1, wherein the rotary shaft connecting rod is provided with two threaded holes, and the fixing screws pass through the threaded holes to lock the light shielding plate onto the plane of the rotary shaft connecting rod.

6. The multifunctional light-control accessory frame according to claim 1, wherein the light shielding plate is provided with holes for mounting adjustable blades, and the adjustable blades are mounted on the light shielding plate through adjustable blade rotary shafts, the adjustable blade rotary shaft comprising two discs and a connecting column, and the two discs being disposed on two ends of the connecting column.

7. The multifunctional light-control accessory frame according to claim 1, wherein the light shielding plate mounting area is provided with at least one positioning plate, and the light shielding plate quick-mounting structure is locked onto the positioning plate.

8. The multifunctional light-control accessory frame according to claim 1, wherein the filter paper clamping plate mounting area is provided with a filter paper clamping plate.

9. The multifunctional light-control accessory frame according to claim 1, wherein the sheet mounting groove is a groove with a slope, and the light shielding plate mounting area is a T-shaped groove which is narrow outside and wide inside.

* * * * *